US011754320B2

(12) United States Patent
Hellmann et al.

(10) Patent No.: US 11,754,320 B2
(45) Date of Patent: Sep. 12, 2023

(54) REFRIGERATION SYSTEM WITH MULTIPLE HEAT ABSORBING HEAT EXCHANGERS

(71) Applicant: Carrier Corporation, Palm Beach Gardens, FL (US)

(72) Inventors: Sascha Hellmann, Hochheim am Main (DE); Nicolas Pondicq Cassou, Aubagne (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 178 days.

(21) Appl. No.: 17/126,860

(22) Filed: Dec. 18, 2020

(65) Prior Publication Data

US 2021/0247108 A1 Aug. 12, 2021

(30) Foreign Application Priority Data

Feb. 10, 2020 (EP) ..... 20156395

(51) Int. Cl.
*F25B 1/10* (2006.01)
*F25B 9/00* (2006.01)
*F25B 5/02* (2006.01)

(52) U.S. Cl.
CPC ..... *F25B 1/10* (2013.01); *F25B 9/008* (2013.01); *F25B 5/02* (2013.01);
(Continued)

(58) Field of Classification Search
CPC .... F25B 1/10; F25B 9/008; F25B 5/02; F25B 2341/0011; F25B 2341/0012;
(Continued)

(56) References Cited

U.S. PATENT DOCUMENTS 6,729,157 B2 5/2004 Oshitani et al.
6,779,360 B2 8/2004 Kawamura et al.
(Continued)

FOREIGN PATENT DOCUMENTS

CN 105546619 B 3/2018
CN 110319612 A 10/2019
(Continued)

OTHER PUBLICATIONS

European Search Report for European Application No. 20156395.4, International Filing Date Feb. 10, 2020, dated Aug. 12, 2020, 6 pages.

(Continued)

*Primary Examiner* — Steve S Tanenbaum
(74) *Attorney, Agent, or Firm* — CANTOR COLBURN LLP

(57) ABSTRACT

Refrigeration systems are described. The systems include a compression device, a heat rejecting heat exchanger, an ejector, and first and second expansion devices with respective heat absorbing heat exchangers. The ejector is arranged to receive refrigerant fluid from the heat rejecting heat exchanger at a high pressure inlet of the ejector. Fluid pathways extend from an outlet of the ejector into a branched flow path to provide flows of refrigerant from the ejector to the first and second expansion devices. The first heat absorbing heat exchanger provides cooling at a first temperature and refrigerant fluid from the outlet of the first heat absorbing heat exchanger is directed to a low pressure inlet of the ejector. The second heat absorbing heat exchanger provides cooling at a second temperature and refrigerant fluid from the outlet of the second heat absorbing heat exchanger is directed to the inlet of the compression device.

19 Claims, 2 Drawing Sheets

(52) U.S. Cl.
CPC ..... *F25B 2341/0011* (2013.01); *F25B 2341/0012* (2013.01); *F25B 2341/0013* (2013.01); *F25B 2400/16* (2013.01)

(58) Field of Classification Search
CPC F25B 2341/0013; F25B 2400/16; F25B 9/08; F25B 2309/061
USPC ..... 62/5
See application file for complete search history.

(56) References Cited

U.S. PATENT DOCUMENTS

| | | | |
|---|---|---|---|
| 6,823,691 | B2 | 11/2004 | Ohta |
| 6,834,514 | B2 | 12/2004 | Takeuchi et al. |
| 6,877,339 | B2 | 4/2005 | Nishijima et al. |
| 6,920,922 | B2 | 7/2005 | Takeuchi |
| 6,925,835 | B2 | 8/2005 | Nishijima et al. |
| 6,931,887 | B2 | 8/2005 | Ogata et al. |
| 6,935,421 | B2 | 8/2005 | Takeuchi et al. |
| 6,978,637 | B2 | 12/2005 | Nishijima et al. |
| 7,086,248 | B2 | 8/2006 | Sakai et al. |
| 7,207,190 | B2 | 4/2007 | Sugiura et al. |
| 8,776,539 | B2 | 7/2014 | Verma et al. |
| 8,783,060 | B2 | 7/2014 | Nishijima et al. |
| 9,217,590 | B2 | 12/2015 | Cogswell et al. |
| 10,208,985 | B2 | 2/2019 | Najafifard |
| 2014/0150489 | A1* | 6/2014 | Gan ..... F25B 49/027 62/428 |
| 2017/0159977 | A1* | 6/2017 | Hellmann ..... F25B 41/20 |
| 2018/0187926 | A1* | 7/2018 | Najafifard ..... F25B 40/02 |

FOREIGN PATENT DOCUMENTS

| | | | |
|---|---|---|---|
| DE | 102008024772 | A1 | 12/2008 |
| EP | 1335169 | B1 | 7/2007 |
| EP | 2570753 | A2 | 3/2013 |
| EP | 2754979 | B1 | 4/2016 |
| EP | 3021058 | A1 | 5/2016 |
| EP | 2718642 | B1 | 9/2016 |
| EP | 2348266 | B1 | 9/2017 |
| EP | 3343130 | A1 | 7/2018 |
| EP | 2565557 | B1 | 2/2019 |
| JP | 4526500 | B2 | 8/2010 |
| JP | 4595654 | B2 | 12/2010 |
| WO | 2015119903 | A1 | 8/2015 |
| WO | 2016180482 | A1 | 11/2016 |
| WO | 2017029011 | A1 | 2/2017 |
| WO | 2019159638 | A1 | 8/2019 |

OTHER PUBLICATIONS

Han, "Energy-efficient Supermarket CO2 Compressor Pack with Ejectors", Norwegian Univeristy of Science and Technology, Department of Energy and Process Engineering, Feb. 2017, 80 pages.

* cited by examiner

REFRIGERATION SYSTEM WITH MULTIPLE HEAT ABSORBING HEAT EXCHANGERS

CROSS-REFERENCE TO RELATED APPLICATIONS

This application claims priority to European Patent Application No. 20156395.4, filed Feb. 10, 2020, the contents of which are incorporated by reference herein in their entirety.

BACKGROUND

The present invention relates to a refrigeration system having multiple heat absorbing heat exchangers, as well as to a corresponding method for providing refrigeration via multiple heat absorbing heat exchangers.

As is well known, refrigeration or heating can be provided by a refrigeration system making use of the refrigeration cycle, in which a refrigerant fluid is compressed, cooled, expanded and then heated. In one common usage, where such a refrigeration system is used for satisfying a cooling load, the cooling of the refrigerant fluid is done via a heat rejection heat exchanger rejecting heat to the atmosphere and the heating of the refrigerant fluid is done via a heat absorbing heat exchanger that absorbs heat from an object to be cooled, such as a refrigerated space for low temperature storage, or an interior of a building to be occupied by people. In this way the refrigeration system can transfer heat from within the building to outside of the building even when the interior is cooler than the atmosphere. A full or partial phase change of the refrigerant fluid can be used to increase the possible temperature differential between the heat rejection and heat absorption stages.

SUMMARY

According to some embodiments, refrigeration systems are provided. The refrigeration systems include a compression device having an inlet for receiving refrigerant fluid at a suction pressure and an outlet for providing compressed refrigerant fluid at a discharge pressure, a heat rejecting heat exchanger arranged to receive compressed refrigerant fluid from the outlet of the compression device, an ejector having a high pressure inlet, a low pressure inlet, and an outlet, the ejector being arranged to receive refrigerant fluid from the heat rejecting heat exchanger at the high pressure inlet of the ejector, fluid pathways extending from the outlet of the ejector and branching into a branched flow path in order to provide refrigerant from the outlet of the ejector to a first expansion device and a second expansion device, a first heat absorbing heat exchanger that is arranged to receive refrigerant fluid from the first expansion device, and a second heat absorbing heat exchanger that is arranged to receive refrigerant fluid from the second expansion device. The first heat absorbing heat exchanger is for providing cooling via refrigerant fluid at a first temperature and refrigerant fluid from the outlet of the first heat absorbing heat exchanger is directed to the low pressure inlet of the ejector. The second heat absorbing heat exchanger is for providing cooling via refrigerant fluid at a second temperature and refrigerant fluid from the outlet of the second heat absorbing heat exchanger is directed to the inlet of the compression device. The second temperature is lower than the first temperature.

In addition to one or more of the features described herein, or as an alternative, further embodiments of the refrigeration systems may include that the first heat absorbing heat exchanger is for air conditioning and is for operating with air side temperatures in the range of 15° C. to 30° C., whereas the second heat absorbing heat exchanger is for a medium temperature application and is for operating with air side temperatures in the range of −25° C. to 8° C.

In addition to one or more of the features described herein, or as an alternative, further embodiments of the refrigeration systems may include that the first expansion device and the second expansion device are arranged to provide differing degrees of expansion.

In addition to one or more of the features described herein, or as an alternative, further embodiments of the refrigeration systems may include that the ejector high pressure inlet receives all of the refrigerant fluid flowing through the heat rejecting heat exchanger.

In addition to one or more of the features described herein, or as an alternative, further embodiments of the refrigeration systems may include including a receiver with an inlet that receives refrigerant fluid from the outlet of the ejector and a liquid outlet that provides refrigerant fluid to the branched flow path.

In addition to one or more of the features described herein, or as an alternative, further embodiments of the refrigeration systems may include that a gas outlet of the receiver is in communication with an intermediate pressure inlet of the compression device.

In addition to one or more of the features described herein, or as an alternative, further embodiments of the refrigeration systems may include that the compression device has two compression stages with the outlet of the second heat absorbing heat exchanger providing refrigerant fluid to a suction inlet of a first compression stage, and a discharge outlet of a second compression stage providing the compressed refrigerant fluid to the heat rejecting heat exchanger.

In addition to one or more of the features described herein, or as an alternative, further embodiments of the refrigeration systems may include an intercooler, wherein the compression device includes an intermediate pressure outlet for directing refrigerant fluid to the intercooler, and the refrigerant fluid from the outlet of the intercooler is directed to the intermediate pressure inlet of the compression device.

In addition to one or more of the features described herein, or as an alternative, further embodiments of the refrigeration systems may include that the refrigeration system being without any further compression devices between the heat rejecting heat exchanger and the ejector and/or without any further compression devices between the ejector and the heat absorbing heat exchangers.

In addition to one or more of the features described herein, or as an alternative, further embodiments of the refrigeration systems may include that the heat rejecting heat exchanger is a gas cooler unit.

In addition to one or more of the features described herein, or as an alternative, further embodiments of the refrigeration systems may include that the refrigeration system is configured for use with a carbon dioxide refrigerant.

In addition to one or more of the features described herein, or as an alternative, further embodiments of the refrigeration systems may include a non-return valve between the outlet of the first heat absorbing heat exchanger and the low pressure inlet of the ejector in order to prevent reversal of flow with fluid flowing away from the ejector.

In addition to one or more of the features described herein, or as an alternative, further embodiments of the refrigeration systems may include a bypass line to allow for refrigerant fluid flow from the outlet of the first heat absorbing heat exchanger to the inlet of the compression device, wherein the by-pass line includes a by-pass valve for controlling the flow of refrigerant fluid along the by-pass line and/or for control of the pressure at the outlet of the first heat absorbing heat exchanger.

In addition to one or more of the features described herein, or as an alternative, further embodiments of the refrigeration systems may include one or more internal heat exchanger(s) for heat transfer between refrigerant fluid at differing temperatures within the refrigeration system.

According to some embodiments, methods for refrigeration with cooling at two temperatures are provided. The methods include providing a refrigeration system as described in any preceding embodiment, using the first heat absorbing heat exchanger to provide a first refrigeration temperature, and using the second heat absorbing heat exchanger to provide a second refrigeration temperature.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
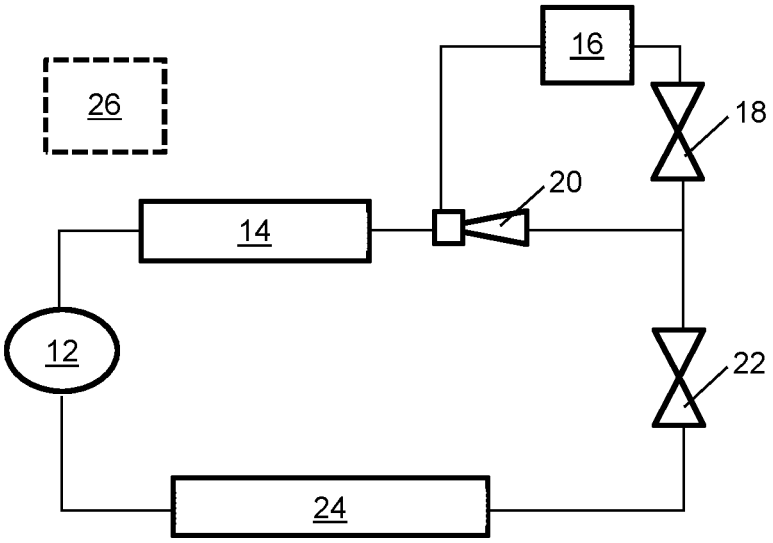
FIG. 1 shows a refrigeration system having two heat absorbing heat exchangers.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

Viewed from a first aspect, the invention provides a refrigeration system comprising: a compression device having an inlet for receiving refrigerant fluid at a suction pressure and an outlet for providing compressed refrigerant fluid at a discharge pressure; a heat rejecting heat exchanger arranged to receive compressed refrigerant fluid from the outlet of the compression device; an ejector having a high pressure inlet, a low pressure inlet, and an outlet, the ejector being arranged to receive refrigerant fluid from the heat rejecting heat exchanger at the high pressure inlet of the ejector; fluid pathways extending from the outlet of the ejector and branching into a branched flow path in order to provide refrigerant from the outlet of the ejector to a first expansion device and a second expansion device; a first heat absorbing heat exchanger that is arranged to receive refrigerant fluid from the first expansion device; and a second heat absorbing heat exchanger that is arranged to receive refrigerant fluid from the second expansion device; wherein the first heat absorbing heat exchanger is for providing cooling via refrigerant fluid at a first temperature and refrigerant fluid from the outlet of the first heat absorbing heat exchanger is directed to the low pressure inlet of the ejector; wherein the second heat absorbing heat exchanger is for providing cooling via refrigerant fluid at a second temperature and refrigerant fluid from the outlet of the second heat absorbing heat exchanger is directed to the inlet of the compression device; and wherein the second temperature is lower than the first temperature.

With this arrangement it is possible to provide cooling at two different temperatures whilst only using a single compression device and a single ejector. The connection of the first heat absorbing heat exchanger between the outlet of the ejector and the low pressure inlet of the ejector allows for it to provide a sub-circuit for the first heat absorbing heat exchanger whilst the second heat absorbing heat exchanger is placed on the main circuit with its outlet directing refrigerant toward the suction inlet of the compression device. The second heat absorbing heat exchanger may operate at the suction pressure of compression device, i.e. the lowest pressure within the circuit, whilst the first heat absorbing heat exchanger may operate at a higher pressure as provided for by the suction pressure at the low pressure inlet of the ejector.

Advantageously, the first heat absorbing heat exchanger may be for air conditioning, and hence may operate with a refrigerant fluid temperature in the range of 0° C. to 25° C. and/or may be arranged for air side temperatures in the range of 15° C. to 30° C., such as for cooling air by 5° C., e.g. from 25° C. to 20° C., whereas the second heat absorbing heat exchanger may be for a medium temperature application such as for a refrigerated cabinet, and hence may operate with a refrigerant fluid temperature in the range of −35° C. to 0° C. and/or may be arranged for air side temperatures in the range of −25° C. to 8° C., such as for cooling the cabinet to an internal temperature in the range 0° C. to 8° C. for chilled storage, or −25° C. to −10° C. for frozen storage. Other possible medium temperature applications include chilled water, in this case the first heat absorbing heat exchanger is a plate or shell/tube heat exchanger cooling water. The refrigeration system may thus conveniently provide cooling for installations requiring combinations of such heat exchangers, such as a building requiring both of air conditioning and refrigerated storage with relatively low capacities involved. This commonly arises in the case of small retail establishments, such as petrol stations or small stores needing air conditioning as well as refrigeration for chilled and/or perishable goods.

The first expansion device and the second expansion device may provide differing degrees of expansion in order to provide the required difference in the refrigerant temperature at the first heat absorbing heat exchanger and the second heat absorbing heat exchanger. The first and/or second expansion devices may for example be an electronic expansion device having a controllable degree of expansion. This allows for control of the expansion device(s) in order to vary the cooling provided by the first heat absorbing heat exchanger and/or the second heat absorbing heat exchanger.

The ejector is used to allow for an additional circuit including the first heat absorbing heat exchanger, and it provides for two suction pressures via the high pressure inlet and low pressure inlet, with the combined flow exiting at the outlet. The ejector advantageously receives all of the refrigerant fluid flowing through the heat rejecting heat exchanger via the high pressure inlet, as well as receiving some or all of the refrigerant fluid that has subsequently passed through the first heat absorbing heat exchanger. The ejector may for example be a low entrainment/high lift modulating ejector. Such an ejector may be arranged to modulating a Kv-value on the motive nozzle throat diameter by means of a regulating device (e.g. an axial adjustable needle or a similar method of an adjustable orifice flow area) and may be made to perform with the overall motive (high side) mass flow but sucking only a partial mass flow at the low pressure suction inlet, which is typically referred to as a low entrainment/high lift method. The ejector may be arranged to provide an ejector uplift between 0 and 15 bar depending on the application and conditions. The refrigeration system may incorporate only a single ejector device, i.e. there may be only one ejector stage as specified above, with inlet connections to the heat rejecting heat exchanger and the first heat absorbing heat exchanger, and outlet connections passing fluid toward the branching flow path. Thus, the refrigeration system advantageously does not include any further ejector device elsewhere within the refrigerant circuit. The single ejector device may however comprise a multi-bank ejector in some implementations.

The refrigeration system may include a receiver with an inlet that receives refrigerant fluid from the outlet of the ejector and a liquid outlet that provides refrigerant fluid to the branched flow path. Thus, the first expansion device and second expansion device may be provided with refrigerant fluid from the liquid outlet of the receiver. This is beneficial since the ejector outlet generally has two phase flow, which has the result that it is difficult to control expansion. A receiver enables the expansion devices to be provided with single phase, liquid, refrigerant fluid, allowing expansion to be more consistent and/or more easily controlled. A gas outlet of the receiver may be in communication with an inlet of the compression device. This may be done via an expansion valve or the compression device may include an intermediate pressure inlet, for example as discussed below.

The compression device may be any suitable form of compressor. Optionally it may provide for two compression stages, for example with the outlet of the second heat absorbing heat exchanger providing refrigerant fluid to a suction inlet of a first compression stage, and a discharge outlet of a second compression stage providing the compressed refrigerant fluid to the heat rejecting heat exchanger. The compression device may use an arrangement of multiple compressor elements in order to provide two-stage compression with an intermediate pressure inlet (and optional intermediate pressure outlet) as discussed above. For example, there may be multiple compressor elements driven by the same compressor motor. The refrigeration system may comprise a single compression device, such as the two-stage device as discussed herein. Optionally the refrigeration system does not use parallel compressors. The refrigeration system may be without any further compression devices between the heat rejecting heat exchanger and the ejector and/or without any further compression devices between the ejector and the heat absorbing heat exchangers. The proposed system hence may not rely on multiple compression devices for multiple differing heat absorption pressures, instead utilizing only the ejector for allowing for differing heat absorption pressures.

The compression device may comprise an intermediate pressure inlet. In one arrangement, the intermediate pressure inlet may be connected to a gas outlet of a receiver as mentioned above. Alternatively, or additionally, the intermediate pressure inlet may be used for an intercooler. In that case the compression device may have an intermediate pressure outlet for directing refrigerant fluid to an intercooler, and the refrigerant fluid from the outlet of the intercooler may be directed to the intermediate pressure inlet, optionally being combined with refrigerant fluid flowing from the gas outlet of the receiver. The intercooler may include an intercooler heat rejecting heat exchanger that is combined with the heat rejecting heat exchanger that receives compressed refrigerant from the outlet of the compression device.

The heat rejecting heat exchanger may be a condenser for at least partially condensing compressed refrigerant fluid from the compression device, so that the refrigerant fluid is liquid at the outlet of the heat rejecting heat exchanger. The condenser and an intercooler as discussed above may combine together for rejecting heat to air in an air flow path passing in sequence over the intercooler and then the condenser. The intercooler and/or the condenser may be provided with suitable heat transfer elements on their exterior, such as fins or the like. The heat rejecting heat exchanger may be a gas cooler unit, for example a gas cooler for carbon dioxide refrigerant. Thus, the refrigeration system may use carbon dioxide as the refrigerant fluid. Alternatively, the refrigeration system may use a high pressure refrigerant aside from carbon dioxide, such as R410A for example.

In a simple configuration of the refrigeration system the outlet of the first heat absorbing heat exchanger is coupled directly to the low pressure inlet of the ejector without any intervening components. However, it has been found that the operating range of the system can be increased if further features are provided to allow for refinements to the control of refrigerant fluid flows to the ejector. In one possible arrangement anon-return valve is provided between the outlet of the first heat absorbing heat exchanger and the low pressure inlet of the ejector in order to prevent reversal of flow with fluid flowing away from the ejector in some operating conditions. In addition, or alternatively, a bypass line may be provided to allow for refrigerant fluid flow from the outlet of the first heat absorbing heat exchanger to the inlet of the compression device. The by-pass line may include a by-pass valve for controlling the flow of refrigerant fluid along the by-pass line and/or for control of the pressure at the outlet of the first heat absorbing heat exchanger. Where a by-pass line is present, the refrigeration system may be arranged for a first mode of operation in which the by-pass valve is closed and all of the refrigerant fluid from the first heat absorbing heat exchanger flows to the ejector low pressure inlet, and a second mode of operation in which the by-pass valve is open or partially open and at least some of the refrigerant fluid from the first heat absorbing heat exchanger flows through the by-pass line.

Optionally the refrigeration system includes one or more internal heat exchanger(s) for heat transfer between refrigerant fluid at differing temperatures within the refrigeration system. Thus, there may be at least one internal heat exchanger for transfer of heat from a first point in the system to a second point in the system.

For example, the first point may be after the ejector outlet and before the expansion devices, optionally prior to the branched flow path, with the second point being after the second heat absorbing heat exchanger and before the inlet of the compression device. In that case, the first point may also be after the receiver with a receiver connected as above, i.e. the first point may be after the liquid outlet of the receiver. This internal heat exchanger may hence transfer heat between liquid refrigerant after the receiver and gaseous (or two phase) refrigerant after the second heat absorbing heat exchanger.

Alternatively or additionally the first point may be after the outlet of the heat rejecting heat exchanger and before the high pressure inlet of the ejector, with the second point being between the gas outlet of the receiver and the inlet to the compression device, such as between the gas outlet of the receiver and the intermediate pressure inlet of the compression device discussed above. This internal heat exchanger may hence transfer heat between refrigerant fluid after the heat rejecting heat exchanger, and gaseous refrigerant after the receiver gas outlet.

Both of the above discussed internal heat exchangers may be present, along with the receiver, so that there is a first internal heat exchanger transferring heat from refrigerant liquid after the receiver liquid outlet to refrigerant fluid after the second heat absorbing heat exchanger, and a second internal heat exchanger transferring heat from refrigerant fluid after the heat rejecting heat exchanger to refrigerant gas after the gas outlet of the receiver.

The internal heat exchangers may be plate type heat exchangers, such as brazed plate type heat exchangers, with counter-flow or cross-flow of refrigerant fluid from the first point and the second point.

Optionally the refrigeration system may include a heat recovery device after the compression device and before the heat rejecting heat exchanger. Thus, there may be a suitable valve arrangement, such as a three-way valve for permitting some of, or all of, the compressed refrigerant to pass through a coil for heat recovery prior to the heat rejecting heat exchanger.

The first and/or second heat absorbing heat exchangers, with refrigerant fluid at the respective first and second temperatures, may optionally be provided in parallel with further heat absorbing heat exchangers with refrigerant fluid at the respective first or second temperature. Thus, the refrigeration system may be arranged for heat absorption via refrigerant fluid at the first temperature using two or more heat absorbing heat exchangers in parallel, such as multiple air conditioning evaporators in an example embodiment, preferably with corresponding multiple expansion valves. Alternatively or additionally, the refrigeration system may be arranged for heat absorption via refrigerant fluid at the second temperature using two or more heat absorbing heat exchangers in parallel, such as multiple medium temperature evaporators in an example embodiment, preferably with corresponding multiple expansion valves.

The refrigeration system may comprise a controller for controlling one or more elements of the system, such as for controlling some or all of the compression device, the first expansion device and the second expansion device. Where optional features such as a bypass line and/or a heat recovery device are present then the controller may be for controlling the respective valves in order to control operation of the bypass and/or heat recovery.

The refrigeration system may be a rack type refrigeration system and hence may comprise a rack mounted compression device. Alternatively, the refrigeration system may be a Cooling Distribution Unit (CDU) type refrigeration system. As noted above, the refrigeration system may use a carbon dioxide refrigerant fluid, and this may be done in context of a rack system or a CDU system.

The refrigeration system may be provided as a part of an installation for providing a combination of air conditioning and medium temperature cooling and the invention thus extends to an installation for providing air conditioning and medium temperature cooling that comprises a refrigeration system as discussed above. The installation may be an installation for a small retail establishment as discussed above, such as a petrol station or a small store.

Viewed from a further aspect, the invention provides a method for refrigeration with cooling at two temperatures, the method comprising providing a refrigeration system as set out above, such as in the first aspect and optionally including further features as discussed above; using the first heat absorbing heat exchanger to provide a first refrigeration temperature; and using the second heat absorbing heat exchanger to provide a second refrigeration temperature.

The method may include cooling air for air conditioning using the first heat absorbing heat exchanger, and/or cooling air for chilling or freezing stored goods using the second heat absorbing heat exchanger.

A simple refrigeration system is shown schematically in FIG. 1 to illustrate the underlying principle of use of an ejector to provide a multi-temperature arrangement. This refrigeration system includes a compression device 12, a heat rejecting heat exchanger 14, an ejector 20, a first expansion device 18, a first heat absorbing heat exchanger 16, a second expansion device 22 and a second heat absorbing heat exchanger 24. The refrigeration system may use a carbon dioxide refrigerant. The refrigeration system contains the refrigerant fluid and circulation of the refrigerant fluid via the compression device 12 enables the refrigeration system to utilize a refrigeration cycle to satisfy two types of cooling load via two different temperatures at the first heat absorbing heat exchanger 16 and the second heat absorbing heat exchanger 24.

The first heat absorbing heat exchanger 16 may for example be for air conditioning, and hence may operate with a refrigerant fluid temperature in the range 0° C. to 25° C. The second heat absorbing heat exchanger 24 is provided for lower temperature cooling, such as for chilled or frozen storage of goods, and hence may operate with a refrigerant fluid temperature in the range −35° C. to 0° C. A higher pressure inlet of the ejector 20 receives refrigerant fluid from the outlet of the heat rejecting heat exchanger 14, and a lower pressure inlet of the ejector 20 receives refrigerant fluid from the outlet of the first heat absorbing heat exchanger 16. It will be appreciated that the arrangement of the ejector 20 allows for two differing temperatures at the two heat absorbing heat exchangers 16, 24, since the pressure at the lower pressure inlet of the ejector 20 can differ from the suction pressure for the compression device 12.

In broad terms, the operation of the various parts of the refrigeration system is as follows. The compression device 12 has an inlet for receiving refrigerant fluid at a suction pressure and an outlet for providing compressed refrigerant fluid at a discharge pressure. The heat rejecting heat exchanger 14 is arranged to receive compressed refrigerant fluid from the outlet of the compression device 12, and the outlet of the heat rejecting heat exchanger 14 is connected to the high pressure inlet of the ejector 20. The ejector also has a low pressure inlet, receiving fluid from the first heat absorbing heat exchanger 14 as noted elsewhere herein, and an outlet from which refrigerant fluid is directed toward the expansion devices 18, 22. The refrigerant fluid reaches the expansion devices via fluid pathways extending from the outlet of the ejector 20 and branching into a branched flow path in order to provide refrigerant from the outlet of the ejector 20 with separate flows directed to the first expansion device 18 and the second expansion device 22.

The first heat absorbing heat exchanger 16 is arranged to receive refrigerant fluid from the first expansion device 18 and the second heat absorbing heat exchanger 24 is arranged to receive refrigerant fluid from the second expansion device 22. The expansion devices 18, 22 can provide a differing degree of expansion so that the first heat absorbing heat exchanger 16 will provide cooling via refrigerant fluid at a first temperature and the second heat absorbing heat exchanger 24 will provide cooling at a second, lower temperature. After heat absorption at the first heat absorbing heat exchanger 16, providing cooling such as for air conditioning, refrigerant fluid from the outlet of the first heat absorbing heat exchanger 16 is directed to the low pressure inlet of the ejector 20. After the other stream of refrigerant fluid passes through second heat absorbing heat exchanger 24 providing lower temperature cooling such as for chilled or frozen storage of goods, refrigerant fluid from the outlet of the second heat absorbing heat exchanger is directed to the inlet of the compression device.

By way of example, the heat rejecting heat exchanger 14 may be a gas cooler unit for cooling of compressed carbon dioxide refrigerant. The heat rejecting heat exchanger 14 may be a condenser for at least partially condensing the refrigerant fluid. The first and second expansion devices 18, 22 are electronic expansion valves 18, 22 for expanding the refrigerant fluid with a controllable degree of expansion, and the first and second heat absorbing heat exchangers 16, 24 are evaporators for at least partially evaporating the refrigerant fluid. The refrigeration system may be arranged so that the refrigerant fluid is fully condensed at the condenser 14, and fully evaporated at the evaporators 16, 24. The compression device 12 is for compression of the refrigerant fluid and for circulation of refrigerant fluid around the refrigeration system.

The refrigeration circuit is controlled by a controller 26, which may for example control the expansion devices 18, 22 and the compressor 12. Control of the refrigeration circuit may be done with reference to various inputs to the controller 26, such as temperature and/or pressure measurements relating to the refrigeration circuit and/or external temperatures, as well as user inputs and so on. The controller 26 in this example can control the expansion devices 18, 22 in order to adapt the refrigeration system for varying cooling loads at the first and second evaporators 16, 24.

Figure 2:
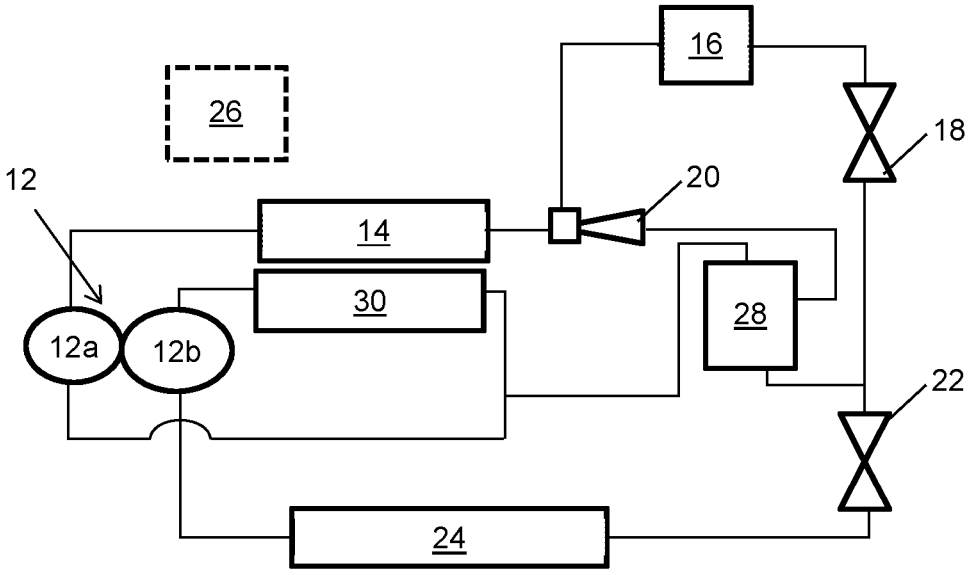
FIG. 2 shows another refrigeration system using two heat absorbing heat exchangers.

FIG. 2 shows a refrigerating system utilizing an ejector 20 in a similar manner to the arrangement of FIG. 1, with the addition of a receiver 28 and also an intercooler 30, along with the use of a compression device 12 with an intermediate pressure inlet, such as a suitable two-stage compression device 12. Although the system of FIG. 1 serves well to explain the basic principle of the proposed arrangement, it is difficult to control in practical terms when there is two phase flow at the expansion devices 18, 22. The additional, optional, features of FIG. 2 allow for easier control of the system with the ability to achieve high levels of efficiency as a consequence. Improvements in the control of the system of FIG. 1 might alternatively be provided by other optional features whilst still retaining a single stage compressor, such as via adding a receiver 28 similar to that of FIG. 2 with a gas outlet of the receiver connected via a suitable valve to the suction inlet of the single stage compressor. One skilled in the art will appreciate that other variations are also possible.

With the arrangement of FIG. 2 an inlet of the receiver 28 receives refrigerant fluid from the outlet of the ejector 20, which can be a two-phase mixture. The receiver separates the refrigerant fluid into liquid and gaseous refrigerant. A liquid outlet of the receiver 28 provides refrigerant fluid (liquid) to the branched fluid pathways and hence the expansion devices 18, 22 will receive liquid refrigerant. Heat absorption by the first and second heat absorbing heat exchangers 16, 24 then proceeds as above. The gas outlet of the receiver 28 is connected to an intercooler circuit along with the intercooler 30, and refrigerant fluid from the gas outlet of the receiver 28 is directed to the intermediate pressure inlet of the two-stage compression device 12. The two stage compression device 12 includes a high pressure stage 12*a*, which takes refrigerant fluid from the intermediate pressure inlet and compresses it to the discharge pressure ready to be directed toward the heat rejecting heat exchanger 14. There is also a low pressure stage 12*b*, which receives refrigerant fluid at the suction pressure from the second heat absorbing heat exchanger and compresses it to an intermediate pressure. The intermediate pressure refrigerant fluid passes from the outlet of the low pressure stage 12*b* through the intercooler 30 and joins with the refrigerant fluid from the gas outlet of the receiver 28, before being directed to the inlet of the high pressure stage 12*a*.

This arrangement allows for better handling of two phase refrigerant from the outlet of the ejector 20 and also adds further cooling of the refrigerant via the intercooler 30. The intercooler 30 can advantageously be used in series with the heat rejecting heat exchanger 14, which may be a gas cooler unit, such as a carbon dioxide gas cooler for use with carbon dioxide refrigerant fluid. Other features of FIG. 2 not mentioned in detail may be the similar to those discussed above for FIG. 1.

Figure 3:
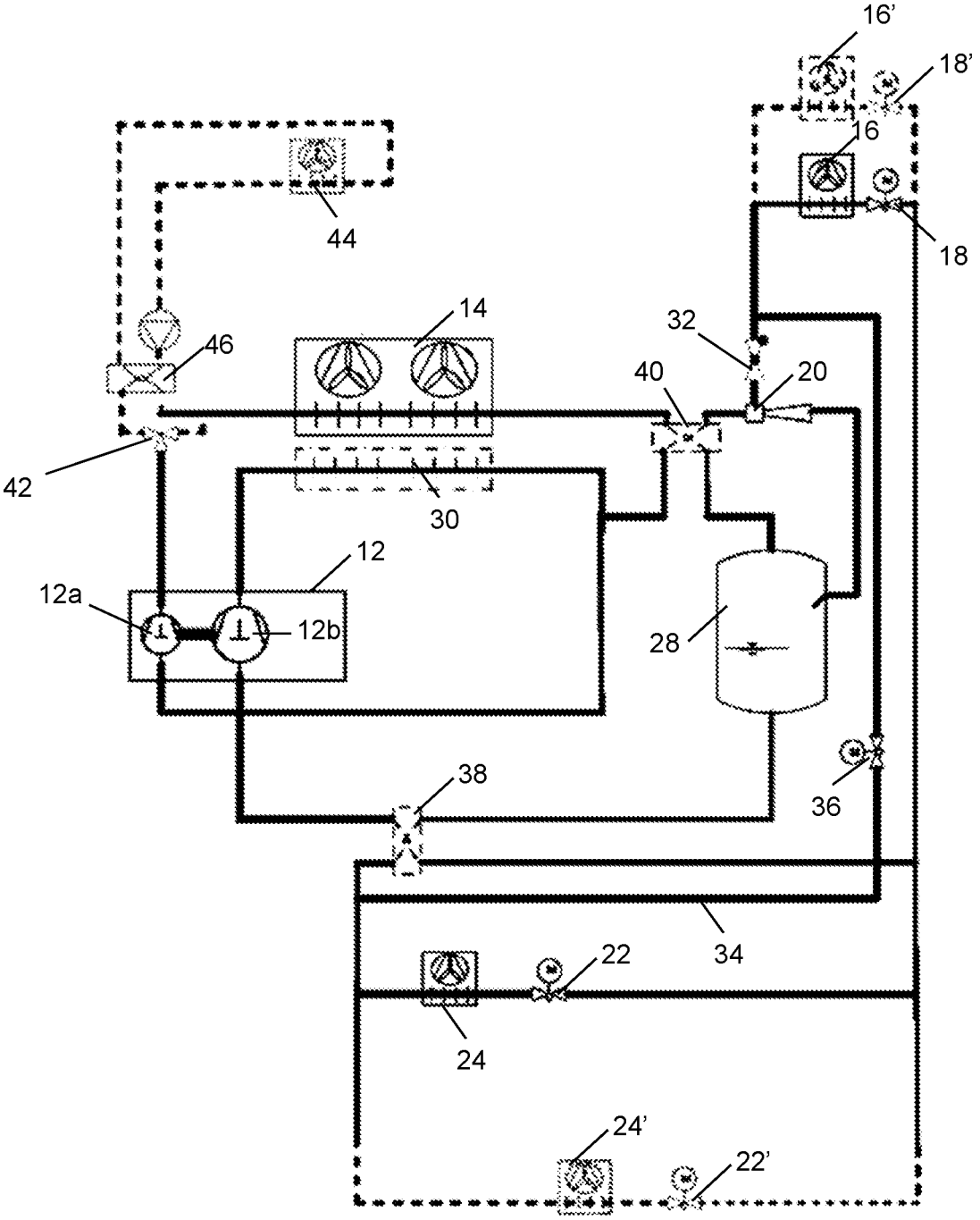
FIG. 3 shows a further refrigeration system using multiple heat absorbing heat exchangers along with internal heat exchangers.

Possible further features of a more sophisticated multi-temperature arrangement are shown in the refrigeration system of FIG. 3. The refrigeration system of FIG. 3 comprises additional elements that can allow for increased operating ranges for the system, as well as greater control when there is a need for varying cooling capacity at the first temperature and the second temperature. The arrangement of FIG. 3 has added features with respect to handling of refrigerant fluid from the outlet of the first heat absorbing heat exchanger, in particular a non-return valve 32 is provided between the outlet of the first heat absorbing heat exchanger 16 and the low pressure inlet of the ejector 20 in order to prevent reversal of flow with fluid flowing away from the ejector 20. In addition, a bypass line 34 may be provide to allow for refrigerant fluid flow from the outlet of the first heat absorbing heat exchanger 16 to the suction inlet of the compression device 12. The by-pass line 34 may include a by-pass valve 36 for controlling the flow of refrigerant fluid along the by-pass line 32 and hence for control of the pressure at the first heat absorbing heat exchanger 16.

The refrigeration system of FIG. 3 also includes one or more internal heat exchanger(s) 38, 40 for heat transfer between refrigerant fluid at differing temperatures within the refrigeration system. These may be brazed plate heat exchangers.

A first internal heat exchanger 38 is provided for transfer of heat from a first flow path after the receiver 28 to a second flow path in the system after the second heat absorbing heat exchanger 24. As seen in FIG. 3, the first flow path of the first internal heat exchanger 38 is between the receiver 28 and the branching point of the flow path to the expansion devices 18, 22. The second flow path of the first internal heat exchanger 38 is after the second heat absorbing heat exchanger 24 and before the inlet of the compression device 12. This first internal heat exchanger hence transfers heat between liquid refrigerant after the receiver 28 and gaseous (or two phase) refrigerant after the second heat absorbing heat exchanger 24.

A second internal heat exchanger 40 is provided for transfer of heat from a first flow path that is after the outlet of the heat rejecting heat exchanger 14 and before the high pressure inlet of the ejector 20, with the second flow path being between the gas outlet of the receiver 28 and the intermediate pressure inlet to the compression device 12. This second internal heat exchanger 40 hence transfers heat between refrigerant fluid after the heat rejecting heat exchanger 14 and refrigerant after the gas outlet of the receiver 28.

Further optional features can also be present as shown by the dashed line features in FIG. 3. For example, the refrigeration system can include a heat recovery device after the compression device 12 and before the heat rejecting heat exchanger 14. Thus, there may be a three-way valve 42 for permitting some, or all, of the compressed refrigerant to pass through a coil 44 for heat recovery prior to the heat rejecting heat exchanger 14. A third internal heat exchanger 46 can be included in the heat recovery system for heat exchange between the hot and cold lines to the coil 44. Alternatively, or additionally, the first and/or second heat absorbing heat exchangers 16, 24 can be in parallel with further heat absorbing heat exchangers 16', 24' that hence also handle refrigerant fluid at the respective first or second temperature. Thus, the refrigeration system can be arranged for heat absorption via refrigerant fluid at the first temperature using two or more heat absorbing heat exchangers 16, 16' in parallel with corresponding multiple expansion valves 18, 18'. For example, there can be multiple air conditioning evaporators. Similarly, the refrigeration system can include two or more heat absorbing heat exchangers 24, 24' in parallel with refrigerant at the second, lower, temperature, such as multiple medium temperature evaporators for chilling or freezing of stored goods. Again, this may be implemented with corresponding multiple expansion valves 22, 22'.

The refrigeration system of FIG. 3 can include a controller (not shown) in a similar manner to that described above, for control of the two-stage compressor 12; the expansion devices 18, 22, as well as the further expansion devices 18', 22', when present; and the various valves, when present, such as the bypass valve 36 and/or three-way valve 42.

When in use, the various refrigeration systems described above each make use of the ejector 20 in a similar fashion in order to allow for two differing pressures for the heat absorbing heat exchangers 16, 24 and hence two differing cooling temperatures.

The use of the terms "a", "an", "the", and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description but is only limited by the scope of the appended claims.

What is claimed is:

1. A refrigeration system comprising:

a single compression device having an inlet for receiving refrigerant fluid at a suction pressure and an outlet for providing compressed refrigerant fluid at a discharge pressure;

a heat rejecting heat exchanger arranged to receive compressed refrigerant fluid from the outlet of the compression device;

an ejector having a high pressure inlet, a low pressure inlet, and an outlet, the ejector being arranged to receive refrigerant fluid from the heat rejecting heat exchanger at the high pressure inlet of the ejector;

fluid pathways extending from the outlet of the ejector and branching into a branched flow path in order to provide refrigerant from the outlet of the ejector to a first expansion device and a second expansion device;

a first heat absorbing heat exchanger configured to receive refrigerant fluid from the first expansion device;

a second heat absorbing heat exchanger configured to receive refrigerant fluid from the second expansion device;

a receiver with an inlet configured to receive refrigerant fluid from the outlet of the ejector and a liquid outlet configured to provide refrigerant fluid to the branched flow; and a first internal heat exchanger provided for transfer of heat from a first flow path after the receiver to a second flow path after the second heat absorbing heat exchanger;

wherein the first heat absorbing heat exchanger is for providing cooling via refrigerant fluid at a first temperature and refrigerant fluid from the outlet of the first heat absorbing heat exchanger is directed to the low pressure inlet of the ejector;

wherein the second heat absorbing heat exchanger is for providing cooling via refrigerant fluid at a second temperature and refrigerant fluid from the outlet of the second heat absorbing heat exchanger is directed to the inlet of the compression device; and wherein the second temperature is lower than the first temperature.

2. A refrigeration system as claimed in claim 1, wherein the first heat absorbing heat exchanger is for air conditioning and is for operating with air side temperatures in the range of 15° C. to 30° C., whereas the second heat absorbing heat exchanger is for a medium temperature application and is for operating with air side temperatures in the range of −25° C. to 8° C.

3. A refrigeration system as claimed in claim 1, wherein the first expansion device and the second expansion device are arranged to provide differing degrees of expansion.

4. A refrigeration system as claimed in claim 1, wherein the ejector high pressure inlet is configured to receive all of the refrigerant fluid flowing through the heat rejecting heat exchanger.

5. A refrigeration system as claimed in claim 1, wherein a gas outlet of the receiver is in communication with an intermediate pressure inlet of the compression device.

6. A refrigeration system as claimed in claim 1, the refrigeration system being without any further compression devices between the heat rejecting heat exchanger and the ejector and/or without any further compression devices between the ejector and the heat absorbing heat exchangers.

7. A refrigeration system as claimed in claim 1, wherein the heat rejecting heat exchanger is a gas cooler unit.

8. A refrigeration system as claimed in claim 1, wherein the refrigeration system is configured for use with a carbon dioxide refrigerant.

9. A refrigeration system as claimed in claim 1, comprising a non-return valve between the outlet of the first heat absorbing heat exchanger and the low pressure inlet of the ejector in order to prevent reversal of flow with fluid flowing away from the ejector.

10. A refrigeration system as claimed in claim 1, wherein the compression device has two compression stages with the outlet of the second heat absorbing heat exchanger providing refrigerant fluid to a suction inlet of a first compression stage, and a discharge outlet of a second compression stage providing the compressed refrigerant fluid to the heat rejecting heat exchanger.

11. A refrigeration system as claimed in claim 10, further comprising an intercooler, wherein the compression device includes an intermediate pressure outlet for directing refrigerant fluid to the intercooler, and the refrigerant fluid from the outlet of the intercooler is directed to an intermediate pressure inlet of the compression device.

12. A refrigeration system as claimed in claim 1, further comprising a bypass line to allow for refrigerant fluid flow from the outlet of the first heat absorbing heat exchanger to the inlet of the compression device.

13. A refrigeration system as claimed in claim 12, wherein the by-pass line includes a by-pass valve for at least one of (i) controlling the flow of refrigerant fluid along the by-pass line and (ii) controlling a pressure at the outlet of the first heat absorbing heat exchanger.

14. A refrigeration system as claimed in claim 1, further comprising a heat recovery device, after the compression device and before the heat rejecting heat exchanger, the heat recovery device comprising a coil and a three-way valve for permitting some, or all, of the compressed refrigerant to pass through the coil for heat recovery prior to the heat rejecting heat exchanger.

15. A method for refrigeration with cooling at two temperatures, the method comprising:

providing a refrigeration system as claimed in claim 1;

using the first heat absorbing heat exchanger to provide a first refrigeration temperature; and using the second heat absorbing heat exchanger to provide a second refrigeration temperature.

16. A method as claimed in claim 15, transferring heat between refrigerant fluid at differing temperatures within the refrigeration system using one or more internal heat exchangers.

17. A method as claimed in claim 15, further comprising bypassing, using a bypass line, refrigerant fluid flow from the outlet of the first heat absorbing heat exchanger to the inlet of the compression device.

18. A method as claimed in claim 15, further comprising receiving refrigerant fluid from the outlet of the ejector at an inlet of a receiver and providing refrigerant fluid to the branched flow path from a liquid outlet of the receiver.

19. A method as claimed in claim 18, wherein a gas outlet of the receiver is in communication with an intermediate pressure inlet of the compression device.

* * * * *